US010530060B2

(12) United States Patent
Wu et al.

(10) Patent No.: US 10,530,060 B2
(45) Date of Patent: Jan. 7, 2020

(54) SINGLE-LAYERED END-FIRE CIRCULARLY POLARIZED SUBSTRATE INTEGRATED WAVEGUIDE HORN ANTENNA

(71) Applicants: Ke Wu, Montreal (CA); Yifan Yin, Montreal (CA)

(72) Inventors: Ke Wu, Montreal (CA); Yifan Yin, Montreal (CA)

(73) Assignee: HUAWEI TECHNOLOGIES CANADA CO., LTD, Kanata (CA)

( * ) Notice: Subject to any disclaimer, the term of this patent is extended or adjusted under 35 U.S.C. 154(b) by 69 days.

(21) Appl. No.: 15/627,158

(22) Filed: Jun. 19, 2017

(65) Prior Publication Data

US 2018/0123254 A1 May 3, 2018

Related U.S. Application Data

(60) Provisional application No. 62/414,433, filed on Oct. 28, 2016.

(51) Int. Cl.

| | |
|---|---|
| ***H01Q 9/04*** | (2006.01) |
| ***H01Q 13/00*** | (2006.01) |
| ***H01Q 13/02*** | (2006.01) |
| ***H01Q 1/22*** | (2006.01) |
| ***H01Q 13/08*** | (2006.01) |
| ***H01Q 1/38*** | (2006.01) |

(52) U.S. Cl.

CPC ..... *H01Q 13/0241* (2013.01); *H01Q 1/2283* (2013.01); *H01Q 1/38* (2013.01); *H01Q 9/0428* (2013.01); *H01Q 13/085* (2013.01)

(58) Field of Classification Search

CPC .... H01Q 13/0241; H01Q 13/02; H01Q 13/08; H01Q 13/085; H01Q 1/22; H01Q 1/2283; H01Q 9/04; H01Q 9/0428; H01Q 9/0457; H01Q 1/38; H01P 3/18

See application file for complete search history.

(56) References Cited

U.S. PATENT DOCUMENTS 3,631,502 A * 12/1971 Peters, Jr. ..... H01Q 13/0225 343/756
5,142,255 A * 8/1992 Chang ..... H01P 1/2013 333/204
6,075,493 A * 6/2000 Sugawara ..... H01Q 1/38 343/767

(Continued)

OTHER PUBLICATIONS

D. Deslandes and K. Wu, "Integrated microstrip and rectangle waveguide in planar form," in IEEE Microwave and Wireless Components Letters, vol. 11, No. 2, pp. 68-70, Feb. 2001.

(Continued)

*Primary Examiner* — Tho G Phan

(57) ABSTRACT

An end fire circularly polarized (CP) substrate integrated waveguide (SIW) horn antenna and a method of manufacturing thereof are described. The antenna includes an input section for receiving radio frequency (RF) waves from a source; and a body extending from the input section for receiving the RF waves from the input section, the body comprising a plurality of radiating units, the plurality of radiating units being configured to radiate circularly polarized waves (CP) in a far field, wherein apertures of the plurality of radiating unit being located along an edge of a planar dielectric substrate, and wherein the horn antenna is in a planar form.

21 Claims, 4 Drawing Sheets

(56) References Cited

U.S. PATENT DOCUMENTS 7,656,358 B2 * 2/2010 Haziza ..... H01Q 13/00 343/772
10,170,839 B2 * 1/2019 Xue ..... H01Q 9/0428

OTHER PUBLICATIONS

Z. L. Li and K. Wu, "An new approach to integrated horn antenna," in Proc. Int. Symp. on Antenna Technology and Applied Electromagnetics, Jul. 2004, pp. 535-538.
H. Wang, D. G. Fang, B. Zhang and W. Q. Che, "Dielectric Loaded Substrate Integrated Waveguide (SIW) H-Plane Horn Antennas," in IEEE Transactions on Antennas and Propagation, vol. 58, No. 3, pp. 640-647, Mar. 2010.
B. Pan, Y. Li. G. E. Ponchak, J. Papapolymerou and M. M. Tentzeris, "A 60-GHz CPW-Fed High-Gain and Broadband Integrated Horn Antenna," in IEEE Transactions on Antennas and Propagation, vol. 57, No. 4, pp. 1050-1056, Apr. 2009.
W. Che, B. Fu, P. Yao, and Y. L. Chow, "Substrate integrated waveguide horn antenna with dielectric lens," Microw. Optic. Technol. Lett., vol. 49, No. 1, pp. 168-170, Jan. 2007.
M. Yousetbeiki, A. A. Domenech, J. R. Mosig and C. A. Fernandes, "Ku-band dielectric-loaded SIW horn for vertically-polarized multi-sector antennas," 2012 6th European Conference on Antennas and Propogation (EUCAP), Prague, 2012, pp. 2367-2371.
Y. Lang and S. W. Qu, "A dielectric loaded H-plane horn for millimeter waves based on LTCC technology," Cross Strait Quad-Regional Science and Wireless Technology Conference (CSQRWC), 2013, Chengdu, 2013, pp. 265-268.
Y. Cai, Z. P. Qian, Y. S. Zhang, J. Jin and W. Q. Cao, "Bandwidth Enhancement of SIW Horn Antenna Loaded With Air-Via Perforated Dielectric Slab," in IEEE Antennas and Wireless Propagation Letters, vol. 13, No. , pp. 571-574, 2014.
Y. Cai, Z. Qian, Y. Zhang and W. Cao, "A Compact Wideband SIW-Fed Dielectric Antenna with End-Fire Radiation Pattern," in IEEE Transactions on Antennas and Propogation, vol. 64, No. 4, pp. 1502-1507, Apr. 2016.
M. Esquius-Morote, B. Fuchs and J. R. Mosig, "A new type of printed Ku-band SIW horn antenna with enhanced performances," Antennas and Propagation (ISAP), 2012 International Symposium on, Nagoys, 2012, pp. 223-226.
M. Esquius-Morote, B. Fuchs and J.R. Mosig, "Enhancing the performances of H-plane SIW horn antennas," Antennas and Propogation (EuCAP), 2013 7th European Conference on, Gothenburg, 2013, pp. 2869-2872.
M. Esquius-Morote, B. Fuchs, J. F. Zürcher and J. R. Mosig, "Novel Thin and Compact H-Plane SIW Horn Antenna," in IEEE Transactions on Antennas and Propagation, vol. 61, No. 6, pp. 2911-2920, Jun. 2013.
M. Esquius-Morote, B. Fuchs, J. F. Zürcher and J. R. Mosig, "A Printed Transition for Matching Improvement of SIW Horn Antennas," in IEEE Transactions on Antennas and Propogation, vol. 61, No. 4, pp. 1923-1930, Apr. 2013.
L. Wang, X. Yin, S. Li, H. Zhao, L. Liu and M. Zhang, "Phases Corrected Substrate Integrated Waveguide H-Plane Horn Antenna With Embedded Metal-Via Arrays," in IEEE Transactions on Antennas and Propagation, vol. 62, No. 4, pp. 1854-1861, Apr. 2014.
Y. Zhao, Z. Shen and W. Wu, "Conformal SIW H-Plane Horn Antenna on a Conducting Cylinder," in IEEE Antennas and Wirelsss Propogation Letters, vol. 14, No. , pp. 1271-1274, 2015.
N. Ghassemi and K. Wu, "Planar High-Gain Dielectric-Loaded Antipodal Linearly Tapered Slot Antenna for E- and W-Band Gigabyte Point-to-Point Wireless Services," in IEEE Transactions on Antennas and Propogation, vol. 61, No. 4, pp. 1747-1755, Apr. 2013
L. Wang, X. Yin and H. Zhao, "A Planar Feeding Technology Using Phase-and-Amplitude-Corrected SIW Horn and Its Application," in IEEE Antennas and Wireless Propogation Letters, vol. 14, No. , pp. 147-150, 2015.
W. J. Lu, J. W. Shi, K. F. Tong and H. B. Zhu, "Planar Endfire Circularly Polarized Antenna Using Combined Magnetic Dipoles," in IEEE Antennas and Wireless Progation Letters, vol. 14, No. , pp. 1263-1266, 2015.
W. H. Zhang, W. J. Lu and K. W. Tam, "A Planar End-Fire Circularly Polarized Complementary Antenna With Beam in Parallel With Its Plane," in IEEE Transactions on Antennas and Propagation, vol. 64, No. 3, pp. 1146-1152, Mar. 2016.
Y. Cai, Y. Zhang, Z. Qian, W. Cao and S. Shi, "Compact Wideband Dual Circularly Polarized Substrate Integrated Waveguide Horn Antenna," in IEEE Transactions on Antennas and Propogation, vol. 64, No. 7, pp. 3184-3189, Jul. 2016.
Yifan Yin, Behnam Zarghooni, and Ke Wu, "A Compact Substrate Integrated Waveguide Circularly Polarized Horn Antenna," submitted to the International Symposium on Antennas and Propagation, Oct. 2016.
Z. Li, X. P. Chen and K. Wu, "A Surface Mountable Pyramidal Horn Antenna and Transition to Substrate Integrated Waveguide," 2007 International Symposium on Signals, Systems and Electronics, Montreal, Que., 2007, pp. 607-610.
Z. Chen and Z. Shen, "Planar Helical Antenna of Circular Polarization," in IEEE Transactions on Antennas and Propagation, vol. 63, No. 10, pp. 4315-4323, Oct. 2015.
Z. Li and K. Wu, "24-GHz Frequency-Modulation Continuous-Wave Radar Front-End System-on-Substrate," in IEEE Transactions on Microwave Theory and Techniques, vol. 56, No. 2, pp. 278-285, Feb. 2008.
X. P. Chen, K. Wu, L. Han and F. He, "Low-Cost High Gain Planar Antenna Array for 60-GHz Band Application," in IEEE Transactions on Antennas and Propagation, vol. 58, No. 6, pp. 2126-2129, Jun. 2010.
D. Stephens, P. R. Young and I. D. Robertson, "W-band substrate integrated waveguide slot antenna," in Electronics Letters, vol. 41, No. 4, pp. 165-167, Feb. 17, 2005.
O. Kramer, T. Djerafi and K. Wu, "Very Small Footprint 60 GHz Stacked Yagi Antenna Array," in IEEE Transactions on Antennas and Propagation, vol. 59, No. 9, pp. 3204-3210, Sep. 2011.
A. R. Mallahzadeh and S. Esfandiarpour, "Wideband H-Plane Horn Antenna Based on Ridge Substrate Integrated Waveguide (RSIW)," in IEEE Antennas and Wireless Propagation Letters, vol. 11, No. , pp. 85-88, 2012.
Y. Zhao, Z. Shen and W. Wu, "Wideband and Low-Profile H-Plane Ridge SIW Horn Antenna Mounted on a Large Conducting Plane," in IEEE Transactions on Antennas and Propagation, vol. 62, No. 11, pp. 5895-5900, Nov. 2014.
S. B. Yeap, X. Qing, M. Sun and Z. N. Chen, "140-GHz 2×2 SIW horn array on LTCC," Antennas and Propagation (APCAP), 2012, IEEE Asia-Pacific Conference on, Singapore, 2012, pp. 279-280.
Y. Cai et al., "Compact Wideband SIW Horn Antenna Fed by Elevated-CPW Structure," in IEEE Transactions on Antennas and Propogation, vol. 63, No. 10, pp. 4551-4557, Oct. 2015.
K. Iigusa, K. Li, K. Sato and H. Harada, "Gain Enhancement of H-Plane Sectoral Post-Wall Horn Antenna by Connecting Tapered Slots for Millimeter-Wave Communication," in IEEE Transactions on Antennas and Propagation, vol. 60, No. 12, pp. 5548-5556, Dec. 2012.
T. Manabe, Y. Miura and T. Ihara, "Effects of antenna directivity and polarization on indoor multipath propagation characteristics at 60 GHz," in IEEE Journal on Selected Areas in Communications, vol. 14, No. 3, pp. 441-448, Apr. 1996.
M. Esquius-Morote, M. Mattes and J. R. Mosig, "Orthomode Transducer and Dual-Polarized Horn Antenna in Substrate Integrated Technology," in IEEE Transactions on Antennas and Propagation, vol. 62, No. 10, pp. 4935-4944, Oct. 2014.
Zhang Yingsong et al: ""Design of millimeter-wave dual circularly polarized end-fire antenna fed by SIW polarizer"", 2016 IEEE MTT-S Internationalmicrowave Workshop Series on Advanced Materialsand Processes for RFAND THZ Applications(IMWS-AMP), IEEE, Jul. 20, 2016, pp. 1-4, XP032977735.
Karsten Kuhlmann et al: "Circularly Polarized Substrate-Integrated Waveguide Antenna Array at Ka-Band", Proc. of German Microwave Conference(GeMl0, 2008, 1O Mar. 2008, pp. 471-474, XP055244686.

(56) References Cited

OTHER PUBLICATIONS

Yu Luo et al: "Substrate integrated waveguide circularly polarized horn-dipole antenna with improved gain", Microwave and Optical Technology Letters, vol. 58, No. 12, Sep. 22, 2016, pp. 2973-2977, XP055514731.

* cited by examiner

SINGLE-LAYERED END-FIRE CIRCULARLY POLARIZED SUBSTRATE INTEGRATED WAVEGUIDE HORN ANTENNA

RELATED APPLICATION

This application is related to U.S. provisional patent application No. 62/414,433, filed Oct. 28, 2016, entitled PLANAR END-FIRE CIRCULARLY POLARIZED SUBSTRATE INTEGRATED WAVEGUIDE HORN ANTENNA, which is incorporated herein by reference.

FIELD

The present invention relates to antennas, and in particular to single-layered end-fire circularly polarized substrate integrated waveguide horn antennas.

BACKGROUND

Three-dimensional horn antennas are commonly used in various applications such as communication systems, radar, imaging, and radio astronomy. In these applications, the horn antenna is used either as an independent antenna or as a feeder for its related reflector antenna. Three-dimensional horn antennas are usually bulky, expensive, and difficult to integrate with other components of a system or device.

Circularly polarized (CP) antennas are typically used in satellite and mobile communication systems. CP antennas have certain advantages over linearly polarized antennas. For example, CP antennas are less sensitive to antenna axial rotation and have less delay spread. Planar CP antennas are typically broadside structures. As well, most CP antennas have a complex feed network and a multi-layer substrates topology, which increases the overall cost and dimensions of the antennas.

SUMMARY

The present disclosure describes a single-layered end-fire CP substrate integrated waveguide horn antenna on a layer of substrate which can, in some configurations, reduce the overall size of the antenna and cost to integrate the antenna. In example embodiments, the antenna comprises a plurality of radiating units for generating CP waves in a far field. The horn antenna is integrated in a layer of substrate and is substantially planar. As the horn antenna is substantially in a planar form, this allows the horn antenna to be integrated in the applications involving substrate integrated circuits (SICs). As well, the number of radiating units of the horn antenna is expandable to achieve a potential higher gain.

According to one aspect, there is provided an end fire circularly polarized (CP) substrate integrated waveguide (SIW) horn antenna that includes an input section for receiving radio frequency (RF) waves from a source; and a body extending from the input section for receiving the RF waves from the input section, the body comprising a plurality of radiating units, the plurality of radiating units being configured to radiate circularly polarized waves (CP) in a far field, wherein apertures of the plurality of radiating unit being located along an edge of a planar dielectric substrate, and wherein the horn antenna is in a planar form.

According to one aspect, there is provided an end fire circularly polarized (CP) substrate integrated waveguide (SIW) horn antenna that includes an input section for receiving radio frequency (RF) waves from a source; and a body extending from the input section and comprising a plurality of radiating units for receiving the RF waves from the input section and radiating corresponding RF waves from respective radiating unit apertures, the plurality of radiating units comprising a first radiating unit for radiating first linearly polarized waves, and a second radiating unit for radiating second linearly polarized waves, wherein at respective radiating unit apertures of the first and second radiating units, the first linearly polarized waves and the second linearly polarized waves have a substantially same amplitude, a phase difference of substantially 90°, and a difference in polarization direction of substantially +/−90°, wherein the input section and the body are formed from a planar dielectric substrate coated with planar conductive layers on opposite sides thereof, two conductive side walls electrically connecting the planar conductive layers, and wherein the radiating unit apertures being located along an edge of the substrate.

Optionally, in any of the preceding aspects, the plurality of radiating units radiating corresponding RF waves from respective radiating unit apertures, the plurality of radiating units comprising a first radiating unit for radiating first linearly polarized waves, and a second radiating unit for radiating second linearly polarized waves, wherein at respective radiating unit apertures of the first and second radiating units, the first linearly polarized waves and the second linearly polarized waves have a substantially same amplitude, a phase difference of substantially 90°, and a difference in polarization direction of substantially +/−90°.

Optionally, in any of the preceding aspects, the first linearly polarized waves are vertically polarized waves.

Optionally, in any of the preceding aspects, the second linearly polarized waves are horizontally polarized waves.

Optionally, in any of the preceding aspects, at least one of the first and second radiating units is an antipodal linearly tapered slot antenna (ALTSA).

Optionally, in any of the preceding aspects, the first radiating unit is adjacent to the second radiating unit.

Optionally, in any of the preceding aspects, the input section and the body are formed from the planar dielectric substrate enclosed by planar conductive layers on opposite sides thereof and two conductive side walls electrically connecting the planar conductive layers.

According to one aspect, there is provided a method of manufacturing an end fire circularly polarized (CP) horn antenna on a substrate having a face side and a bottom side, the method includes covering the face side of the substrate with a face side conductive layer; covering the bottom side of the substrate with a bottom side conductive layer; forming conductive side walls for electrically connecting the face side conductive layer and the bottom side conductive layer; forming a plurality channels by cutting or etching through the face conductive layer, the substrate, and the bottom conductive layer; and forming conductive dividing walls by metalizing two surfaces of each of the channels, wherein the top and bottom conductive layers, the conductive side walls, the conductive dividing walls, and the substrate form the horn antenna comprising a plurality of radiating units, wherein plurality of radiating units radiate circularly polarized waves in a far field, and wherein the horn antenna is in a planar form.

BRIEF DESCRIPTION OF THE DRAWINGS

Reference will now be made, by way of example, to the accompanying drawings which show example embodiments of the present disclosure, and in which.

Similar reference numerals may have been used in different figures to denote similar components.

DETAILED DESCRIPTION

The structure, shape, and manufacture of example embodiments are discussed in detail below. The specific examples discussed are merely illustrative of specific ways to make and use embodiments of the invention, and do not limit the scope of the invention.

Figure 1:
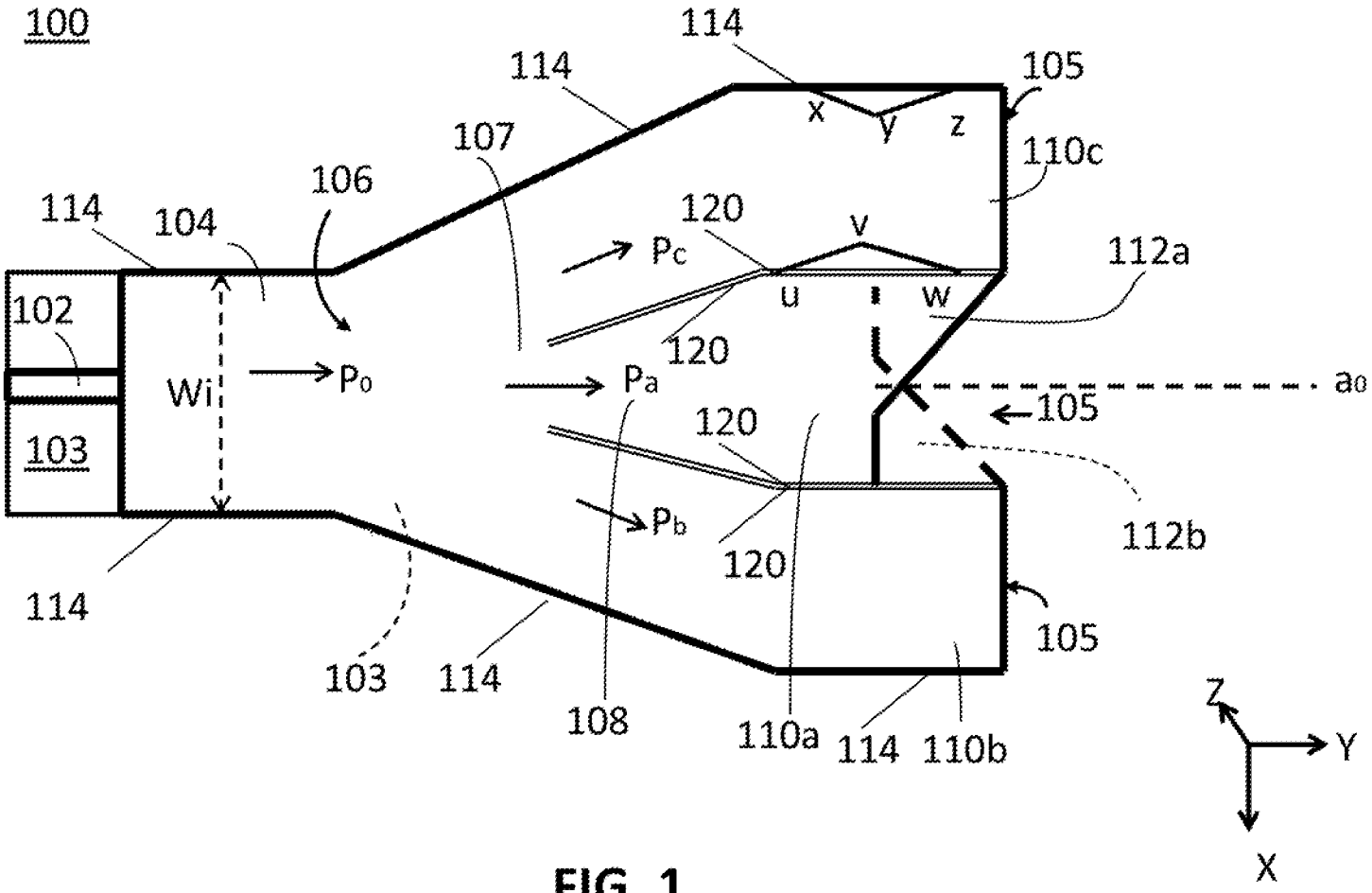
FIG. 1 is a top view of an example single-layered end-fire CP substrate integrated waveguide (SIW) horn antenna, according to example embodiments.
Figure 2:
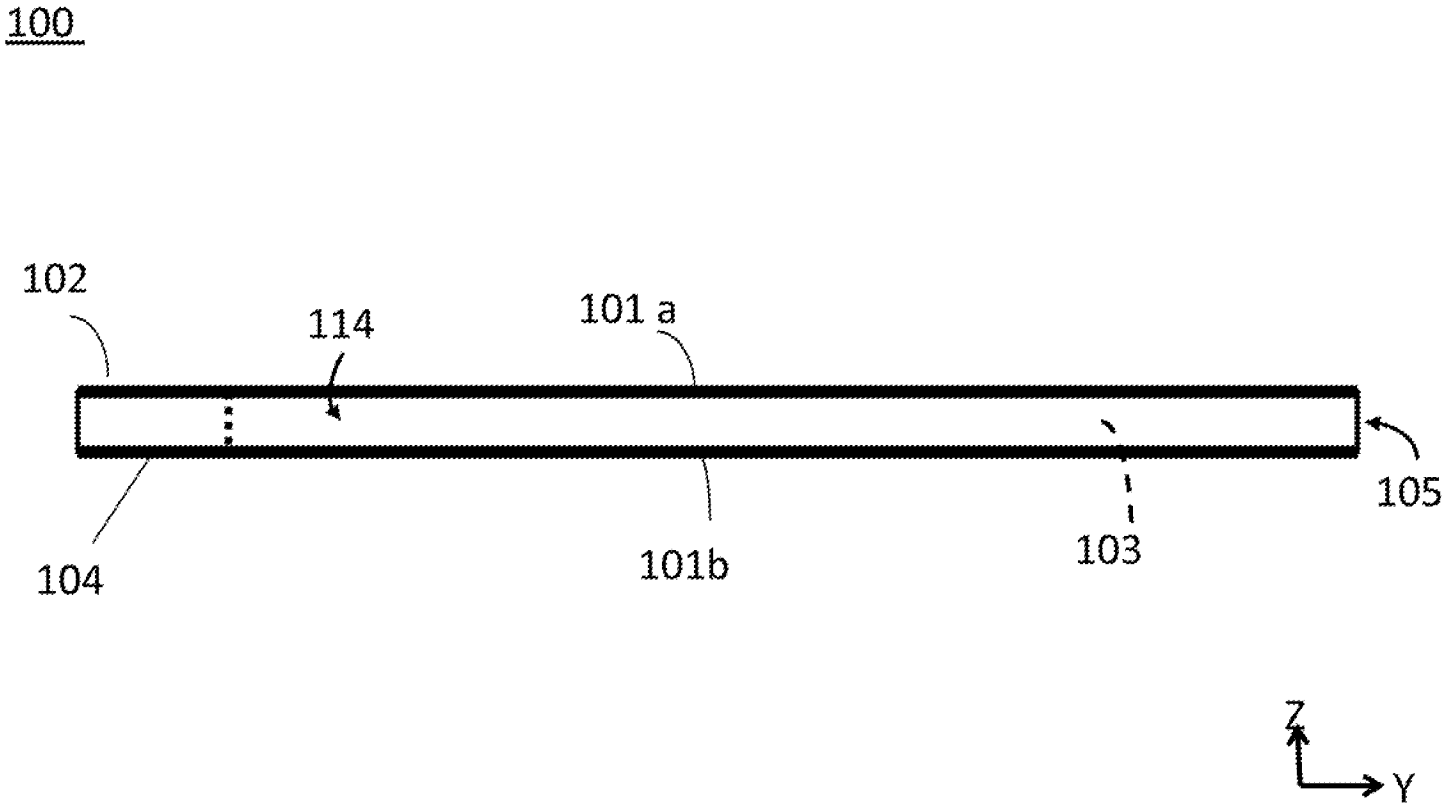
FIG. 2 is a side view of the example single-layered end-fire CP SIW horn antenna of FIG. 1.
Figure 3:
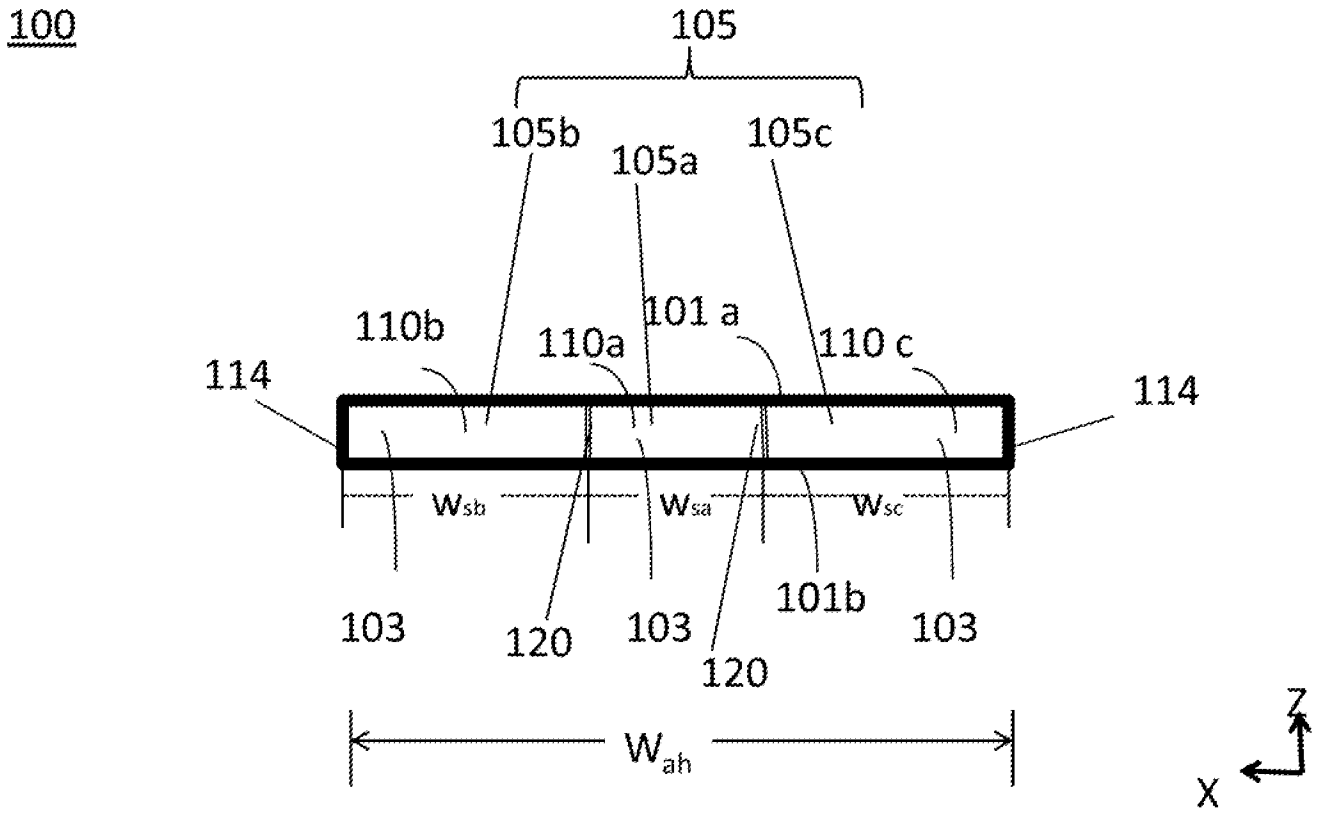
FIG. 3 is a front end view of the example single-layered end-fire CP SIW horn antenna of FIG. 1.

FIGS. 1-3 illustrate an example single-layered end-fire CP SIW horn antenna 100 ("horn antenna 100"). Substrate integrated waveguide (SIW) is an integrated waveguide-like structure.

As illustrated in FIGS. 1-3, horn antenna 100 includes a single integrated substrate layer 103. The shape and structure of the horn antenna 100 may be varied as long as the horn antenna 100 is in a planar form and includes a single integrated substrate layer.

In some example embodiments, the horn antenna 100 includes a metallic top layer 101*a* and a metallic bottom layer 101*b* (FIG. 2), and two metallic side walls 114. The metallic top layer 101*a*, the metallic bottom layer 101*b*, and two metallic side walls 114 enclose a layer of dielectric substrate 103 therein. The two metallic side walls 114 are electrically connected with the metallic top layer 101*a* and the metallic bottom layer 101*b*. The two metallic side walls 114 may be formed by two rows of metallic via arrays, two rows of metalized cylinders or slots embedded in the dielectric substrate 103, or two metallic walls.

The metallic top layer 101*a*, the metallic bottom layer 101*b*, the two metallic side walls 114, and the layer of substrate 103 form a SIW, within which radio frequency (RF) waves propagate towards an antenna aperture 105, where the substrate 103 is exposed and not covered with any metallic layer or metallic wall.

As illustrated in FIG. 1, the horn antenna 100 includes an input section 104 at a first end of the SIW and the antenna aperture 105 (FIG. 3) at a second end of the SIW, and a body 106 between the first and second ends. The body 106 is coupled to the input section 104 and the antenna aperture 105 for propagating RF waves from the input section 104 to the antenna aperture 105. The input section 104 functions as a waveguide, which may be an SIW straight structure, for receiving input RF waves from a source, for example, a coaxial cable or a waveguide. In some examples, conductive microstrip feeds 102 are provided on opposite sides of the substrate 103 to connect the input RF waves to the input section 104. The microstrip feed 102 provides an interface between existing RF circuits and the horn antenna 100. The microstrip feed 102 is electrically coupled to the input section 104 of the horn antenna 100, enabling RF waves received by the microstrip feed 102 to be fed into the input section 104 with little or no loss.

As propagation characteristics of RF waves in an SIW are similar to a rectangular waveguide, the width $W_i$ of the input section 104 meets the condition of a single mode transmission of a waveguide, namely, the width $W_i$ of the input section 104 allows RF waves of a specific mode with a frequency higher than a threshold frequency ("the cutoff frequency") to propagate inside the waveguide with minimal attenuation. RF waves with a frequency lower than the cutoff frequency will be attenuated and will not propagate inside the waveguide.

The RF waves may be $TE_{n0}$ (Transverse Electric) mode, such as $TE_{10}$ mode. In an example, $TE_{10}$ mode is the dominant mode of the horn antenna 100, the cutoff frequency is:

$$f_c = \frac{c}{2a}$$

Where $f_c$ is the waveguide cutoff frequency in Hz, c is the speed of light within the waveguide in meters per second, a is the internal dimension of the waveguide in meters. For example, $a=W_i$ of input section 104 so that the RF waves with frequency higher than the cutoff frequency $f_c$ can be transmitted through the SIW.

In some examples, the cutoff wavelength $\lambda_c$ can be used interchangeably with the cutoff frequency $f_c$. The cutoff wavelength is the maximum wavelength that will propagate in a waveguide, and $\lambda_c=c/f_c$.

In example embodiments, to have a desired wave beam width in YZ plane, the substrate 103 has a thickness of about $0.12\lambda$, where $\lambda$ is the central operating frequency of the horn antenna 100 and $\lambda<=\lambda_c$. The thicker the substrate 103 is, the narrower the wave beam in YZ plane. The height of the antenna aperture 105 in the Z-axis direction is substantially determined by the thickness of the substrate 103. The area of the aperture 105 typically is determined by the height and the width of the antenna aperture 105. The bigger the area of the aperture 105 is, the higher gain of the horn antenna 100.

At the antenna aperture 105, RF waves propagated inside the horn antenna 100 radiate to the free space. The total width $W_{ah}$ (FIG. 3) of the aperture 105 in X axis direction is equal or greater than $W_i$.

The body 106 of the horn antenna 100 is the portion between the input section 104 and the aperture 105. The body 106 flares RF waves into a beam, prepares the RF waves beam to be radiated at the antenna aperture 105 and adjusts the phase difference of the linearly polarized waves radiated by a plurality of radiating units of the horn antenna 100. In an example, the body 106 includes a flaring section 107 and an output section 108. The flaring section 107 is a flaring horn-shaped SIW to direct RF waves into a beam. The output section 108 is an SIW for preparing the waves beam to be radiated at the antenna aperture 105 and for adjusting the phase difference of the linearly polarized waves.

The body 106 of the horn antenna 100 includes a plurality of radiating units. In the example of FIG. 1, the body 106 of the horn antenna 100 includes three radiating units, for example, subhorns 110*a*, 110*b*, and 110*c*. In an example, the plurality of radiating units are arranged side by side and are substantially parallel to each other along X axis.

The radiating units 110*a*, 110*b*, and 110*c* may be formed on the body 106 by dividing the substrate 103 into a plurality of sections and adding further metallic dividing walls 120, such as metallic via arrays or metallic walls, between the two side walls 114. For example, radiating units 110*a*, 110*b*, and 110*c* in FIG. 1 are formed by dividing the body 106 of the horn antenna 100 into a plurality of radiating units with metallic dividing walls 120. In the example of FIG. 1, the metallic dividing walls 120, the portions of the top and bottom metallic layers between the side walls 114 and dividing walls 120, and the portions of the substrate enclosed therein form three sub-waveguides or three radiating units 110*a*, 110*b*, and 110*c* for the RF waves to propagate inside the horn antenna 100.

In some examples, odd number of metallic dividing walls 120, such as 1, 3, or 5, etc, are formed between the two side walls 114 to divide the body 106 of the horn antenna 100 into even radiating units, such as 2, 4, or 6, etc. For example, a metallic dividing wall 120 is formed in the middle of the two side walls 114 to substantially equally divide the body 106 into two radiating units. In other examples, even number of metallic dividing walls 120, such as 2, 4, or 6, etc, are formed between the two side walls 114 to divide the body 106 into odd number of radiating units, such as 3, 5, or 7, etc. For example, four metallic dividing walls 120 may be placed between the two side walls 114 and horn antenna 100 includes five radiating units in this case. In the case of even number of dividing walls 120, relative positions, structures, and shapes of metallic dividing walls 120 may be arranged to be substantially symmetrical to the axis $a_0$ of the aperture 105.

A metallic side wall 120 in FIG. 1 may be formed on two spaced-apart metallic walls. In this case, the metallic dividing wall 120 includes two spaced-apart metallic walls. Each metallic dividing wall 120 forms a side metallic wall of a radiating unit. Alternatively, the metallic dividing wall 120 is a single metallic wall shared by two adjacent radiating units.

In the examples of FIG. 1, each radiating units 110*a*, 110*b*, and 110*c* has an aperture 105*a*, 105*b* and 105*c*, respectively. The apertures 105*a*, 105*b*, and 105*c* are arranged along an edge of the substrate 103 (see FIG. 3). The edge is not covered with any metallic walls or layers. The width of the aperture 105*a*, 105*b*, and 105*c* of the radiating units is $W_{sa}$, $W_{sb}$, and $W_{sc}$, respectively, and each of $W_{sa}$, $W_{sb}$, and $W_{sc}$, is greater than 0.5λ of the RF waves to be radiated by the radiating units 110*a*, 110*b*, and 110*c*. As well, each of $W_{sa}$, $W_{sb}$, and $W_{sc}$ is greater than the cutoff wavelength of the central frequency.

The total width $W_{ah}=W_{sa}+W_{sb}+W_{sc}$. With a given $W_{ah}$, the theoretical gain of the horn antenna 100 is determined. As illustrated in FIG. 1, the width $W_{ah}$ of the antenna aperture 105 is defined by the relative positions of the two side walls 114, and the relative positions of the metallic dividing walls 120 within the body 106 of the horn antenna 100 define the widths $W_{sa}$, $W_{sb}$, and $W_{sc}$ of the apertures 105*a*, 105*b*, 105*c* of the radiating units 110*a*, 110*b*, and 110*c*. As described above, the thickness of substrate 103 defines the height of the apertures 105*a*, 105*b*, 105*c* of the radiating units 110*a*, 110*b*, and 110*c*.

The horn antenna 100 in FIG. 1 is configured to radiate circularly polarized waves. Circular polarization refers a polarization state of an electromagnetic wave where electric field vector of the wave has a constant magnitude at each point, and the direction of the wave rotates with time at a steady rate in a plane perpendicular to the direction of propagation. To generate CP waves, the waves radiated from radiating units of the horn antenna 100 meet the following conditions:

1) the polarization directions of the electric field of the RF waves at the apertures of two radiating units are substantially orthogonal to obtain a wide 3 dB axial ratio (AR) beamwidth;
2) the amplitude of the orthogonal RF waves at the apertures of two radiating units in far field zone are substantially the same; and
3) the phase difference between the orthogonal RF waves at the apertures of two radiating unit in far field zone is substantially a 90 degree In an example, the RF waves input into and propagate inside the horn antenna 100 are $TE_{10}$ mode, and the RF waves are vertically polarized waves ("vertical waves"). In $TE_{10}$ mode, the electric fields are transverse to the direction of propagation and no longitudinal electric field is present. $TE_{10}$ denotes that one half-wave pattern, namely, ½λ is across the width of the waveguide and no half-wave pattern is across the height of the waveguide.

In example embodiments of FIG. 1, the horn antenna 100 includes two types of radiating units: one radiates horizontally polarized waves ("horizontal waves"), namely that, polarization of electric fields of the RF waves is parallel to the substrate 103, evaluated in the far field; and the other radiates vertical waves, namely that, polarization of electric fields of the RF waves is vertical to the substrate 103, evaluated in the far field. Vertically and horizontally polarized waves are examples of linearly polarized waves.

In the example of FIG. 1, radiating unit 110*a* radiates horizontal waves ("horizontal radiating unit"), and functions as a horizontal antenna that generates horizontal waves. In the example of FIG. 1, the radiating unit 110*a* is an antipodal linearly tapered slot antenna (ALTSA) unit. The horizontal radiating unit 110*a* may also be a planar antenna generating horizontal waves, including, for example, a tapered slot antenna, a Vivaldi antenna, planar Yagi antenna, or planar log-periodic dipole antenna.

In FIG. 1, the radiating unit 110*a* includes a top tapered wing 112*a* formed on the metallic top layer 101*a* and a bottom tapered wing 112*b* formed on the metallic bottom layer 101*b*. The bottom tapered wing 120*b* is obscured by the substrate 103 and is illustrated with dash lines. The top tapered wing 112*a* connects to the top metallic layer 101*a* of radiating unit 110*a*, and the bottom tapered wing 112*b* connects to the bottom metallic layer 101*b* of the radiating unit 110*a*. In an example, each of the tapered wings 112*a* and 112*b* of horn antenna 100 has a tapered tip. The tapered tip may be formed by etching or cutting relevant portions of the metallic layer of the radiating unit 110*a* to form an ALTSA unit. The top and bottom tapered wings 112*a* and 112*b* flare linearly toward the opposite dividing walls 120. With the tapered wings 112*a* and 112*b* of the radiating unit 110*a*, which are parallel to the substrate 103, the polarization direction of the RF waves in radiating unit 110*a* is gradually rotated about 90 degrees at the aperture 105*b*. In other words, the RF waves of radiating unit 110*a* are rotated from vertical waves at the input section 104 of the horn antenna 100 to substantially horizontal waves at the aperture 105*b*.

In some example embodiments, the tapered wings 112*a* and 112*b* in FIG. 1 are substantially symmetrical to the each other with respect to the axis $a_0$ of the radiating unit 110*a*. The horn antenna 100 may include more than one ALTSA units, and each ALTSA unit has two tapered wings and one axis. In an example, one tapered wing is substantially symmetrical to the other tapered wing with respect to the axis of the ALTSA unit.

In the example of FIG. 1, if the input RF waves are $TE_{10}$ mode, the radiating units 110*b* and 110*c* do not change the polarization direction of the RF waves of $TE_{10}$ mode and radiate vertical waves ("vertical radiating units"). Each of the radiating units 110*b* and 110*c* functions as a vertical antenna that generates vertical waves.

The horn antenna 100 includes at least one horizontal radiating unit and one vertical radiating unit. In the example of FIG. 1, the body 106 of the horn antenna 100 includes one horizontal radiating unit 110*a*, and two vertical radiating units 110*b* and 110*c*. The two vertical radiating units 110*b* and 110*c* may be arranged on the two sides of the horizontal radiating unit 110*a* and substantially symmetrically with respect to the axis $a_0$ of the radiating unit 110*a* of the horn antenna 100. In some examples, the radiating unit 110*a* is configured as a vertical radiating unit and the radiating units 110*b* and 110*c* may be configured as horizontal radiating units and arranged symmetrically with respect to the axis $a_0$. In some example embodiments, the radiating units of the horn antenna 100 are arranged in such a manner that for every two adjacent radiating units, one radiating unit radiates vertical waves, and the other radiates horizontal waves. In another example, the axial ratio of the antenna 100 is less or equal to 3 dB.

In some examples, the horn antenna 100 include two types of radiating units: a first type of the radiating unit, such as radiating unit 110*a*, rotates the polarization direction of the input RF waves from an initial polarization direction $\Theta$ to a first degree $\Theta_1$ at the aperture 105*a* of the first type radiating unit 110*a*, and a second type of the radiating unit, such as 110*b* or 110*c*, rotates the polarization direction of the input RF waves from the initial polarization direction $\Theta$ to a second degree $\Theta_2$ at the aperture 105*b* or 105*c* of the second type radiating unit, so that the difference between polarization direction of $\Theta_1$ and $\Theta_2$ ($\Theta_1-\Theta_2$) is substantially +/−90°. For example, when the input RF waves is in $TE_{10}$ mode, the first type radiating unit rotates the input RF waves from vertical waves ($\Theta$=90°) to a linearly polarized waves with a polarization direction of $\Theta_1$($\Theta_1$=0°) at the aperture 105*a* of the first type radiating unit 110*a*, and the second type radiating unit rotates the input RF waves from vertical waves to a linearly polarized waves with a polarization direction of $\Theta_2$ ($\Theta_2$=90°) at the aperture 105*b* or 105*c* of the second type radiating unit 110*b* or 110*c*, and the difference between polarization direction of $\Theta_1$ and $\Theta_2$ is substantially +/−90°.

The amplitude of RF waves radiated from a radiating unit of the horn antenna 100 may be adjusted substantially the same by controlling the aperture width of the radiating unit. In the example of $TE_{10}$ mode, the RF wave has the highest wave input power or amplitude at the central axis of the aperture 105 of the horn antenna 100. In the example of FIG. 1, the central axis is the same as $a_0$ of the radiating unit 110*a*. The input power or amplitude of the input $TE_{10}$ mode RF waves in the body of the antenna 100 gradually decrease in the space farther away from the central axial direction $a_0$ of the antenna 100. As such, if the aperture width of the radiating units is the same, centrally located radiating unit 110*a* generally receives a higher input power or has higher amplitude of the RF waves compared to the lateral radiating units 110*b* and 110*c*. As radiating units 110*b* and 110*c* are symmetrical to the axis $a_0$ of the radiating unit 110*a*, the aperture width of radiating units 110*b* and 110*c* is substantially the same, namely that $W_{sb}=W_{sc}$. The wider is the aperture size of a radiating unit, the more power the radiating unit receives. The width of the aperture may be adjusted by the relevant positions of side walls 114 and 120. The principle of maintaining the amplitudes of the waves radiated from different polarized radiating units to be the same will be further discussed below in view of FIG. 4.

To generate phase difference of substantially a 90 degree in far field, the phase of the RF waves in a radiating unit may be controlled by adjusting the distance between the side walls 114 and/or dividing walls 120 of the radiating unit. If the distance between the two side walls of a radiating unit becomes narrower, the speed of the phase of the waves propagated inside the radiating unit will be faster. By adjusting the distance between the side walls of the radiating unit, 90 degrees phase difference between the two different polarized waves radiated from two differently polarized radiating units can be achieved at respective apertures of the two different polarized radiating units. For example, with the aid of a simulation software, such as CST Microwave STUDIO, in response to the change of distance between the side walls 114 and 120 of a radiating unit, the phase of the RF waves at the aperture of the radiating unit can be observed and therefore the desired distance can be determined. The principle of generating 90 degrees phase difference between the two different polarized waves radiated from two different radiating units will be further discussed below in view of FIG. 4.

In another embodiment, the phase of the RF waves radiated from a radiating unit may be further adjusted by further modifying a portion of a side wall 114 and/or 120 of the radiating unit. For example, a portion of a side wall 114 or dividing wall 120 on one side of a radiating unit may be further carved out so that the distance between the portion of the side wall and the corresponding portion of the corresponding side wall will become narrower. As such, only the phase of the waves radiated from the specific radiating unit has changed, and the phase of the waves radiated from the adjacent radiating unit is not affected. As illustrated in FIG. 1, a side wall 120 may be further carved into the radiating units 110*c* for the area of xyz, and a side wall 114 may be further carved into the radiating units 110*c* for the area of uvw. In this case, only the phase of the waves radiated from the radiating unit 110*c* has been changed, and the side wall 120 of the radiating unit 110*a* is not affected. As such, the phase of the RF waves radiated from the radiating unit 110*a* is not affected.

As well, to radiate a CP wave, the two radiation patterns generated by number of vertical radiating units and horizontal radiating units of the horn antenna 100, namely, the shapes of the waves radiated from the radiating units 110*a* and 110*b*, and from the radiating units 110*c*, are substantially the same, especially in the main lobes of the radiation pattern.

In an example, to radiate a CP wave in a far field, the two phase centers of the RF waves generated by the vertical radiating units and horizontal radiating units are coincided if the RF waves are viewed from the far field. For example, the phase centers of the RF waves are coincided if the waves are generated by an odd number radiating units. The horn antenna 100 performs better when the number of the radiating units is an odd number. With odd number of radiating units, the phase central points of the vertically polarized waves radiated from the vertical radiating units coincide at the phase central points of horizontal waves radiated from the horizontal radiating units in the far field.

The CP waves may rotate in a left sense or in a right sense. The arrangement of the tapered wings 112*a* and 112*b* of the radiating unit 110*a* in FIG. 1 produce CP waves rotating in the left sense. Exchanging the positions of the two tapered wings 112*a* and 112*b* of the radiating unit 110*a* in FIG. 1 changes the sense of the CP waves. In the example of FIG. 1, if tapered wing 112*a* is on the bottom and tapered wing 112*b* is on the top, the CP waves will rotate in right sense.

In addition to defining aperture width $W_{sa}$, $W_{sb}$, and $W_{sc}$ of radiating units 110*a*, 110*b*, and 110*c*, relative positions of metallic dividing walls 120 are related to the power ratio of these radiating units. As illustrated in FIG. 1, the body 106 of the horn antenna 100, which may include the flaring section 107 and the output section 108, together with the side walls 114 and 120, divide the initial input power $P_0$ of the RF waves into three portions: $P_a$ in radiating unit 110*a*, $P_b$ in radiating unit 110*b*, and $P_c$ in radiating unit 110*c*.

Figure 4:
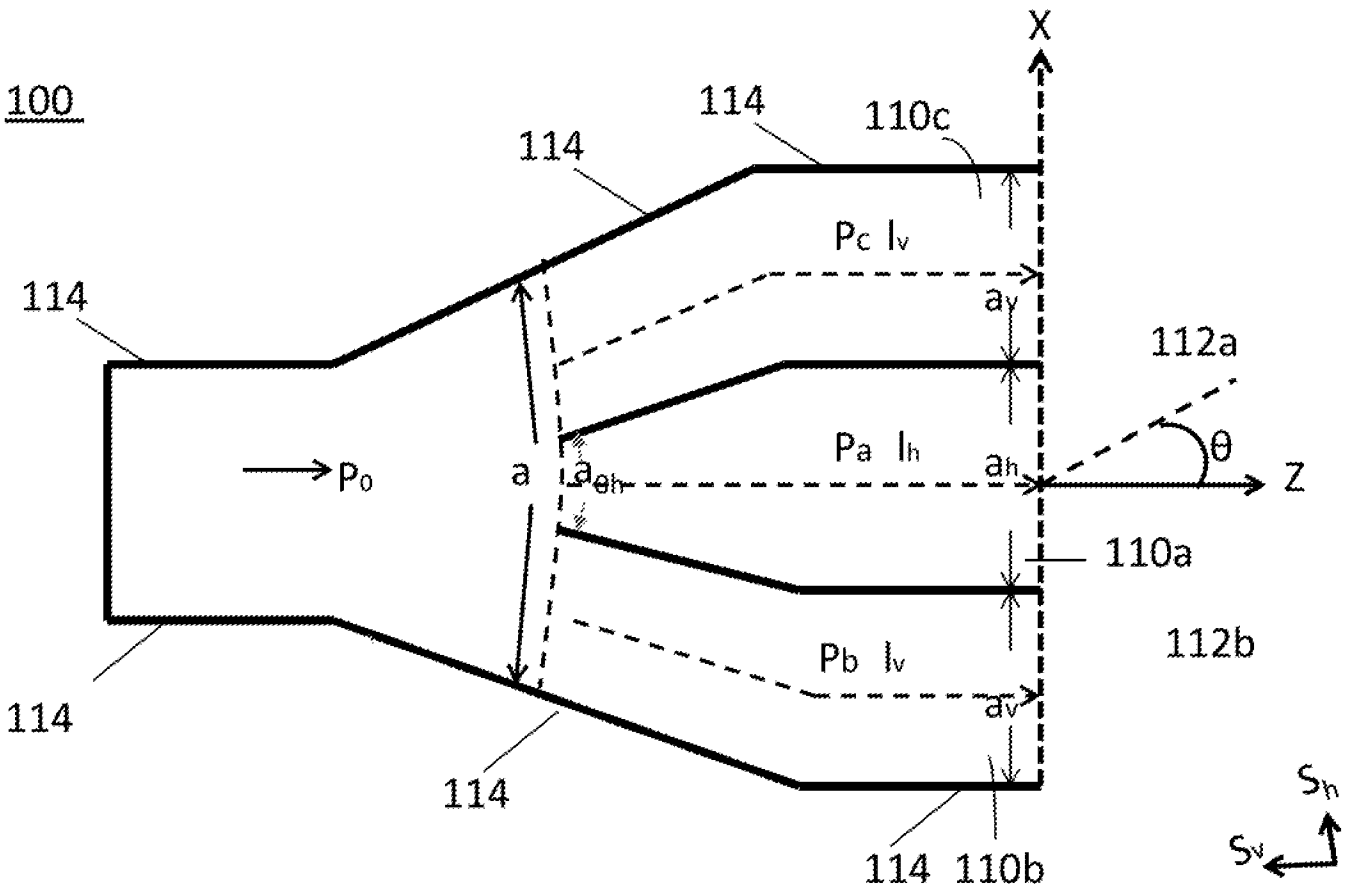
FIG. 4 is a diagram showing power division of the example single-layered end-fire CP SIW horn antenna of FIG. 1.

Reference is made to FIG. 4. The relationship between the input power of the horizontal radiating unit 110*a* for generating horizontal RF waves for the dominant mode $TE_{10}$, which is an example of $TE_{n0}$ and the radiating units 110*b* and 110*c* for generating vertical RF waves for the dominant mode $TE_{10}$ can be deduced in equation (1) below. For a dominant mode $TE_{10}$, the receiving power $P_0$ of the body 106 is expressed as $$P_0 = \frac{E_0^2 ha}{4Z} \tag{1}$$

where h is the thickness of substrate 103, a is the width of the flaring section 107 at the opening of the radiating units 110*a* 110*b* and 110*c* as illustrated in dotted line. $E_0$ is the maximum value of electric field at the opening of the radiating units 110*a*, 110*b* and 110*c*. Z is the wave impedance of the substrate 103 in free space, for which $$Z = \sqrt{\frac{\mu}{\varepsilon}} \tag{2}$$

where μ and ε are permeability and permittivity of the substrate 103, respectively.

The body 106 is divided into the radiating units 110*a*, 110*b* and 110*c*, and $P_a$ is the input power of radiating units 110*a* ($P_a$ in FIGS. 1 and 4), for which $$P_a = \frac{E_0^2 ha}{4Z\pi}\left[\frac{\pi a_{0h}}{a} + \sin\frac{\pi a_{0h}}{a}\right] \tag{3}$$

where $a_{0h}$ is the opening width of the radiating units 110*a*. The input power $P_b$ of radiating units 110*b* ($P_b$ in FIG. 1) is $$P_b = \frac{P_0 - P_a}{2} \tag{4}$$

The input power $P_c$ of radiating units 110*c* ($P_c$ in FIG. 1) is the same as $P_b$. From (1) and (3) we have $$P_b = \frac{E_0^2 ha}{4Z\pi}\left[\frac{\pi}{2a}(a - a_{0h}) - \frac{1}{2}\sin\frac{\pi a_{0h}}{a}\right] \tag{5}$$

Let $S_h$ to be the density of power flux of the radiating wave in the far field zone from radiating units 110*a*, and $S_h$ is expressed as $$S_h = \frac{P_a G_h}{4\pi r^2} f_h(\theta, \varphi) \tag{6}$$

where r is the distance from the horn antenna 100 to the far field zone, $G_h$ is the power gain of radiating units 110*a*, and $f_h(\theta,\varphi)$ is the normalized directivity of radiating units 110*a*. θ (see FIG. 4) and φ are spatial angles of the radiated RF waves.

Radiating units 110*b* and 110*c* radiate vertically polarized wave and function as a two-element antenna array. Let $S_v$ to be the density of power flux of radiating units 110*b* and 110*c* in the far-field zone, and $S_v$ can be deduced as follows:

$$S_v = \frac{2P_b G_v}{4\pi r^2} 2\cos^2(0.5k(a_h + a_v)\sin\theta) f_v(\theta, \varphi) \tag{7}$$

Where $G_v$ is the power gain of radiating unit 110*b* or 110*c*, and $f_v(\theta,\varphi)$ is the normalized directivity of radiating unit 110*b* or 110*c*. k is wave number in free space, $a_h$ ($W_{sa}$ in FIG. 3) is the aperture width of radiating units 110*a*, and $a_v$ ($W_{sb}$ and $W_{sc}$ in FIG. 3) is the aperture width of the lateral radiating units 110*b* or 110*c*.

Because radiating units 110*a*, 110*b* and 110*c* reach the maximum radiation in endfire direction, namely, along the axis $a_0$ of horn antenna 100, the $f_h(\theta,\varphi)$ and $f_v(\theta,\varphi)$ are 1 when θ=0 and φ=0. To be a CP wave, $S_h$ and $S_v$ should be the same when θ=0 and φ=0. Based on equations (6) and (7), it gives $$P_a G_h = 4P_b G_v \tag{8}$$

Combining (3) and (5) into (8) gives $$\left[\frac{\pi a_{0h}}{a} + \sin\frac{\pi a_{0h}}{a}\right] G_h = 2\left[\pi\left(1 - \frac{a_{0h}}{a}\right) - \sin\frac{\pi a_{0h}}{a}\right] G_v \tag{9}$$

Therefore, by properly selecting the width of the flaring section 107 (a) at the opening of the radiating units 110*a* 110*b* and 110*c*, opening width of the radiating units 110*a* ($a_{0h}$), the power gains of radiating units 110*a* ($G_h$), and radiating unit 110*b* and 110*c* ($G_v$), $S_h$ and $S_v$ can be substantially the same.

As described above, where all conditions to generate CP waves are met, $S_h$ and $S_v$ are substantially the same within the range of the main lobe of radiation pattern at a spatial angle with respect to the axis $a_0$ of the horn antenna 100. Accordingly, a circularly polarized wave may be generated over a wide range of spatial angle θ. $S_h$ and $S_v$ are substantially the same within the range of the main lobe of radiation pattern at a spatial angle with respect to the axis $a_0$ of the horn antenna 100. Accordingly, an objective function may be defined for the design of the CP horn antenna 100, which is $\mathrm{Min}|S_h - S_v|$. Based on equations (3) to (8), the objective function can be rewritten as follows:

$$\mathrm{Min}|f_h(\theta,\varphi) - \cos^2(0.5\ k(a_h + a_v)\sin\theta) f_v(\theta,\varphi)| \tag{10}$$

The objective function (10) concerns the span of the spatial angles θ and φ on both XZ and YZ planes. As described above, if an aperture is wider in a plane, wave beam generated in the plane is narrower. In the example of the horn antenna 100 in FIG. 1, the apertures of radiating units 110*a*, 110*b*, and 110*c* in YZ plane are narrower than in the XZ plane. As such, both radiating units 110*b* and 110*c* have wider beams on the YZ plane than on the XZ plane. Radiating units 110*b* and 110*c* effectively form a two-element array to narrow the beam on the XZ plane. From the far field, because of the odd numbers of radiating units, the central radiating unit 110*a* and the array of two radiating units 110*b* and 110*c* have the same phase center along the axis $a_0$ of the aperture of radiating unit 110*a* of the horn antenna 100.

In addition to substantial equality in amplitudes of the RF waves generated from radiating units 110*a*, 110*b*, and 110*c*, a phase difference of 90 degrees may be achieved over an operating frequency range, for example, 24 GHz. The phase difference along the length of radiating units 110*b* and 110*a* can be written as follows $$\varphi=\beta_v l_v-\beta_h l_h \tag{11}$$

where, as illustrated in FIG. 4, is the distance that the waves propagated inside the radiating units 110*b* and 110*c* with the propagation constants of $\beta_v$; and $l_h$ is the distance that the waves propagated inside the radiating unit 110*a* with the propagation constants $\beta_h$. $\beta_v$ and $\beta_h$ are determined by the medium of substrate 103 in respective radiating units 110*a*, 110*b*, and 110*c*. To generate circularly polarized RF waves, the phase difference between the radiating units 110*a* and 110*b* or between the radiating units 110*a* and 110*c* is substantially 90 degrees (90°), therefore $$\beta_v l_v - \beta_h l_h = n\pi \pm \frac{\pi}{2} \tag{12}$$

As such, by properly selecting the medium of substrate 103 and the lengths of respective radiating units, the phase difference of substantially 90 degrees (90°) between the vertical and horizontal radiating units can be achieved.

On the other hand, the speed of the phase difference variation should remain as small as possible when the frequency of operation changes, so that the phase difference is insensitive to the change of the frequency of the waves. Since $$\beta_v = \frac{2\pi}{\lambda}\sqrt{1-\left(\frac{\lambda}{2a_v}\right)^2} \tag{13}$$

and $$\beta_h = \frac{2\pi}{\lambda}\sqrt{1-\left(\frac{\lambda}{2a_h}\right)^2} \tag{14}$$

The speed of the phase difference variation can be formulated as follows:

$$\frac{d\varphi}{d\lambda} = -\frac{2\pi}{\lambda^2}l_v\sqrt{1-\left(\frac{\lambda}{2a_v}\right)^2} - \frac{2\pi}{\lambda}l_v\frac{1}{\sqrt{1-\left(\frac{\lambda}{2a_v}\right)^2}}\frac{\lambda}{4a_v^2} + \frac{2\pi}{\lambda^2}l_h\sqrt{1-\left(\frac{\lambda}{2a_h}\right)^2} + \frac{2\pi}{\lambda}l_h\frac{1}{\sqrt{1-\left(\frac{\lambda}{2a_h}\right)^2}}\frac{\lambda}{4a_h^2} \tag{15}$$

Based on equations (15) and (12), the speed of the phase difference variation in terms of the frequency can be derived as follows:

$$\lambda\frac{d\varphi}{d\lambda} = \left(n \pm \frac{1}{2}\right)\pi^2 + \frac{\pi}{2}\left(\frac{l_v\lambda_{gv}}{a_v^2} - \frac{l_h\lambda_{gh}}{a_h^2}\right) \tag{16}$$

in which parameters $\lambda_{gv}$ is the average guided wavelength in the radiating units 110*b* and 110*c*, $\lambda_{gh}$ is the average guided wavelength in the radiating units 110*a*, and n is an integer.

In practice, the second term in the right side of equation (16) would be smaller than the first term if the absolute value of n in the first term is large enough. Therefore, the absolute value of n should be as small as possible in order to keep the speed of the phase difference variation as small as possible and to preserve the 90 degree phase difference. For example, n=0.

As described above, the side walls 114 and dividing walls 120 define the shape of the radiating units 110*a*, 110*b*, and 110*c*. As well, the relative positions of the side walls 114 and 120 are related to the phase and amplitude of the waves radiated from the radiating units. In order to keep the radiation pattern of the central radiating unit 110*a* and lateral radiating units 110*b* and 110*c* as similar as possible, a commercial or customized software package may be used to determine the desired shape and position of the side walls 114 and 120, based on the equations (8) and (14) to simulate the waves radiated from the radiating units. With the simulation results, relative positions or width of the side walls may be further adjusted, for example, with carved out portion xyz and uvw of radiating unit 110*c*, as described above.

Using the SIW technology, the horn antenna 100 may be manufactured by using a printed circuit board (PCB) design process, which is a low-cost standard technology, or by using other fabrication techniques to design and implement large-scale substrate integrated circuits (SICs). As well, H-plane SIW horn antennas, for example, antipodal linearly tapered slot antennas (ALTSA), are commonly used for SICs-related applications.

For example, the horn antenna 100 may be manufactured on a dielectric substrate 103, such as a printed circuit board (PCB). The substrate 103 has a top side and a bottom side. The top side and the bottom side of the substrate 103 may be covered with conductive layers, such a top metallic layer 101*a* and a bottom metallic layer 101*b*, respectively. In an embodiment, the metallic layers may be copper plates. In another embodiment, the conductive layers may be printed or coated on the substrate 103, for example, by a 3D metal printer. Tools, such as laser, may be used to cut through the top metallic layer 101*a*, the substrate 103, and the bottom metallic layer 101*b* according to the simulated positions and shapes of side walls 114 and 120 to form channels, which define the shapes of horn antenna 100 and respective radiating units 110*a*, 110*b*, and 110*c*. The relevant left and right sides of the channels are metalized with metallic via array technology or metallic walls technology for forming metallic side walls 114 and dividing walls 120. As such, each of the radiating units 110*a*, 110*b*, and 110*c* of horn antenna 100 forms a waveguide with the relevant portions of metallic layers 101*a* and 101*b*, the substrate 103, and relevant side walls 114 and dividing walls 120. An edge of the substrate 103 uncovered with any metallic layer provides the apertures 105*a*, 105*b*, 105*c* of the radiating unit 110*a*, 110*b*, and 110*c*. The tapered wings of ALTSA units, such as 112*a* and 112*b* of horn antenna 100 may be formed by etching or cutting relevant portions of the metallic layer of the relevant radiating units to form one or more ALTSA units for rotating polarization directions of the RF waves. Relevant portions of the metallic layer cut away may be determined with the aid of commercially available software. The portion of the substrate 103 between the relevant portions of the metallic layer of the ALTSA units is not cut away to keep the medium property between the metallic layers of the ALTSA radiating unit unchanged. The order of the steps to form the horn antenna 100 is only illustrative but not restrictive and it may be modified.

With the SIW technology, the horn antenna 100 may be formed on one layer of substrate 103. As well, because all elements of an SIW are on a single layer substrate 103, the SIW is easier to manufacture and the overall size and cost of the horn antenna 100 can be reduced. In addition, as the horn antenna 100 is substantially in a planar form, this allows the horn antenna 100 to be integrated in the applications involving substrate integrated circuits (SICs). As well, the number of radiating units of the horn antenna 100 can be increased to achieve a potential higher gain.

Performance of the Horn Antenna

By selecting proper type of radiating units, such as ALTSA radiating unit, a higher gain of the horn antenna 100 may be achieved even the layer of substrate 103 has a thickness of 0.12λ. In at least some applications, simulation results have indicated that horn antenna 100 at 24 GHz central frequency has a high gain. According to simulation results, horn antenna 100 having ALTSA as horizontal radiating unit has 8 dB gain in most of the 22.5 GHz to 25.5 GHz. On the other hand, if electric current ring or the dipole is used as horizontal radiating unit, the gain of the antenna will be lower, for example, about 2 dB.

Horn Antenna 100 has a good impedance matching with the output impedance of a transceiver. According to simulation results, horn antenna 100 has a scattering parameter $S_{Rx\text{-}Rx}$ equal or substantially less than −10 dB in most of the frequency range of 22.5 GHz to 25.5 GHz.

Horn Antenna 100 generates CP waves in the frequency range 23.7 GHz to 25.15 GHz. According to simulation results, horn antenna 100 has an axial ratio less or equal to 3 dB in the frequency range 23.7 GHz to 25.15 GHz.

As well, horn Antenna 100 has a good directivity. According to simulation results, power density of the horn antenna 100 is concentrated in vertical plane (ZY plane) about −30° to 30°, power density of the horn antenna 100 is concentrated in horizontal plane (XZ plane) is about −15° to 15°.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

The invention claimed is:

1. An end fire circularly polarized (CP) substrate integrated waveguide (SIW) horn antenna, comprising:

an input section for receiving radio frequency (RF) waves from a source; and a body extending from the input section for receiving the RF waves from the input section, the body comprising a plurality of radiating units, the plurality of radiating units being configured to radiate circularly polarized waves (CP) in a far field, the plurality of radiating units having respective radiating apertures located along an edge of a planar dielectric substrate, and wherein the horn antenna is in a planar form, wherein the plurality of radiating units comprise a first radiating unit for radiating first linearly polarized waves from the radiating aperture thereof and a second radiating unit for radiating second linearly polarized waves from the radiating aperture thereof, a polarization direction of the first linearly polarized waves being orthogonal to that of the second linearly polarized waves.

2. The antenna of claim 1, wherein the first linearly polarized waves and the second linearly polarized waves have a substantially same amplitude, a phase difference of substantially 90°, and a difference in the polarization directions of substantially +/−90°.

3. The antenna of claim 2, wherein the first linearly polarized waves are vertically polarized waves.

4. The antenna of claim 2, wherein the second linearly polarized waves are horizontally polarized waves.

5. The antenna of claim 2, wherein at least one of the first and second radiating units is an antipodal linearly tapered slot antenna (ALTSA).

6. The antenna of claim 2, wherein circularly polarized waves formed by the first linearly polarized waves and the second linearly polarized waves rotate in a left sense.

7. The antenna of claim 2, wherein the first radiating unit is adjacent to the second radiating unit.

8. The antenna of claim 1, wherein the radiating units are subhorns.

9. The antenna of claim 1, further comprising a microstrip feed electrically coupled to the input section, the microstrip feed receiving and feeding the RF waves to the input section.

10. The antenna of claim 1, wherein the input section is an SIW straight structure.

11. The antenna of claim 1, wherein the plurality of radiating units are formed by dividing the body with metallic walls.

12. The antenna of claim 1, wherein the plurality of radiating units are formed by dividing the body with metal via array.

13. The antenna of claim 1, wherein the plurality of radiating units are an odd number.

14. The antenna of claim 13, wherein the radiating units comprises a central radiating unit, and other radiating units are arranged symmetrically with respect to the central radiating unit.

15. The antenna of claim 14, wherein the central unit radiates horizontally polarized waves.

16. The antenna of claim 14, wherein the central unit radiates vertically polarized waves.

17. The antenna of claim 1, wherein a width of each of the respective radiating unit apertures is larger than 0.5λ of the RF waves to be radiated by the radiating units, and wherein λ is a wavelength of the RF waves at a central operating frequency.

18. The antenna of claim 1, wherein the substrate has a thickness of about 0.12λ, and wherein λ is a wavelength of the RF waves at a central operating frequency.

19. The antenna of claim 1, wherein the axial ratio of the horn antenna is less or equal to 3 dB.

20. The antenna of claim 1, wherein the input section and the body are formed from the planar dielectric substrate enclosed by planar conductive layers on opposite sides thereof and two conductive side walls electrically connecting the planar conductive layers.

21. An end fire circularly polarized (CP) substrate integrated waveguide (SIW) horn antenna, comprising:

an input section for receiving radio frequency (RF) waves from a source; and a body extending from the input section for receiving the RF waves from the input section, the body comprising a plurality of radiating units, the plurality of radiating units being configured to radiate circularly polarized waves (CP) in a far field, wherein radiating apertures of the plurality of radiating unit being located along an edge of a planar dielectric substrate, and wherein the horn antenna is in a planar form, and wherein the plurality of radiating units radiate corresponding RF waves from respective radiating unit apertures, the plurality of radiating units comprising a first radiating unit for radiating first linearly polarized waves, and a second radiating unit for radiating second linearly polarized waves, wherein at respective radiating unit apertures of the first and second radiating units, the first linearly polarized waves and the second linearly polarized waves have a substantially same amplitude, a phase difference of substantially 90°, and a difference in polarization direction of substantially +/−90°.

* * * * *